US005254184A

United States Patent [19]

Magee, Jr. et al.

[11] Patent Number: 5,254,184

[45] Date of Patent: Oct. 19, 1993

[54] CORROSION RESISTANT DUPLEX STAINLESS STEEL WITH IMPROVED GALLING RESISTANCE

[75] Inventors: John H. Magee, Jr.; Theodore Kosa, both of Reading; Donald K. Schlosser, Shillington, all of Pa.

[73] Assignee: Carpenter Technology Corporation, Reading, Pa.

[21] Appl. No.: 893,774

[22] Filed: Jun. 5, 1992

[51] Int. Cl.[5] ..... C22C 38/44

[52] U.S. Cl. ..... 148/325; 148/327

[58] Field of Search ..... 148/325, 327

[56] References Cited

U.S. PATENT DOCUMENTS

| | | | |
|---|---|---|---|
| 3,337,331 | 8/1967 | Ljungberg | 420/69 |
| 3,929,520 | 12/1975 | Hellner et al. | 148/327 |
| 4,039,356 | 8/1977 | Schumacher et al. | 420/44 |
| 4,101,347 | 7/1918 | Fujikura et al. | 148/327 |
| 4,640,817 | 2/1987 | Kajimura et al. | 420/50 |
| 4,678,523 | 7/1987 | Sridhar et al. | 148/325 |
| 4,814,140 | 3/1989 | Magee, Jr. | 420/56 |

OTHER PUBLICATIONS

"Microstructure and Properties of High Silicon Duplex Stainless Steels", Kazuo Ichii et al., *Transactions ISIJ*, vol. 23, 1983.

*Primary Examiner*—Deborah Yee

*Attorney, Agent, or Firm*—Dann, Dorfman, Herrell and Skillman

[57] ABSTRACT

A duplex stainless steel having a good combination of galling resistance and corrosion resistance is disclosed containing in weight percent about:

| | Broad | Intermediate | Preferred |
|---|---|---|---|
| C | 0.1 Max. | 0.05 Max. | 0.025 Max. |
| Mn | 0-6 | 1-4 | 1-3 |
| Si | 2.5-6 | 3-6 | 4-5 |
| Cr | 16-24 | 17-22 | 18-21 |
| Ni | 2-12 | 6-10 | 7-9 |
| Mo | 4 Max. | 0.5-3 | 1.0-2 |
| N | 0.07-0.30 | 0.10-0.25 | 0.15-0.20 |

and the balance of the alloy is essentially iron. In the annealed condition the alloy is limited to about 15-50% v/o ferrite. To attain its good galling resistance, the alloying elements are balanced so that the % Ni+0.68 (% Cr)+0.55 (% Mn)+0.45 (% Si)+(% C+% N)+% Mo+0.2 (% Co), is at least about 27.5, and the Ni/Si ratio is not more than about 2.5.

21 Claims, No Drawings

CORROSION RESISTANT DUPLEX STAINLESS STEEL WITH IMPROVED GALLING RESISTANCE

FIELD OF THE INVENTION

This invention relates to a duplex stainless steel alloy and in particular to such an alloy, and articles made therefrom, having a better combination of galling resistance and corrosion resistance than known stainless steels.

BACKGROUND OF THE INVENTION

It is generally known that the standard types of stainless steels leave much to be desired with respect to galling resistance. In many commercial applications utilizing stainless steel, such as food processing apparatus, lubricants cannot be used to prevent galling of the steel surface. For food processing and other applications, several galling resistant stainless steel alloys were developed having superior galling resistance compared to conventional austenitic stainless steels. Two specialty galling resistant stainless steels, sold under the respective trademarks Nitronic 60 ® and Gall-Tough ®, have high threshold galling stress values (TGS), nominally 7 ksi (48 MPa) and 15 ksi (103 MPa), respectively. U.S. Pat. No. 4,039,356, Schumacher et al., describes the galling resistant austenitic stainless steel alloy sold under the trademark Nitronic 60 ®. That alloy consists essentially of, in weight percent (%):

| | % |
|---|---|
| C | 0.001–0.25 |
| Mn | 6–16 |
| Si | 2–7 |
| Cr | 10–25 |
| Ni | 3–15 |
| Mo | 4.0 max. |
| N | 0.001–0.4 |
| Cu | 4.0 max. |
| Fe | Bal. |

U.S. Pat. No. 4,814,140, Magee, Jr., assigned to Carpenter Technology Corp., assignee of the present application, describes a galling resistant austenitic stainless steel alloy sold under the trademark Gall-Tough ®. That alloy consists essentially of, in weight percent:

| | % |
|---|---|
| C | 0.25 max. |
| Mn | 2.0–7.0 |
| Si | 1.0–5.0 |
| Cr | 12–20 |
| Ni | 2.0–7.75 |
| Mo | 3.0 max. |
| N | 0.35 max. |
| Cu | 3.0 max. |
| Fe | Bal. |

The austenitic stainless steel alloys described in Schumacher, et al. and Magee, Jr. provide galling resistance that is superior to the standard types of austenitic stainless steels. The alloys disclosed and claimed in Schumacher et al. and Magee, Jr. provide general corrosion resistance comparable to Type 304 stainless steel. That level of corrosion resistance is adequate for uses in many chloride-containing environments. However, some applications, such as valve components in the petrochemical industry, require galling resistance that is superior to conventional austenitic stainless steels and chloride corrosion resistance, especially pitting resistance, that is at least as good as that provided by AISI Type 316 stainless steel.

Type 316 stainless steel, an austenitic stainless steel, has very good chloride pitting resistance. However, Type 316 stainless steel has a nominal threshold galling stress less than 1 ksi (6.89 MPa). Known duplex stainless steels such as UNS S32950, UNS S31803, and UNS S32550 also provide good pitting resistance, but each has a threshold galling stress less than 1 ksi (6.89 MPa). Thus, neither Type 316 nor the known duplex stainless steels have the combination of galling and pitting resistance necessary for petrochemical applications.

It would be highly desirable to have a stainless steel alloy which provides a superior combination of galling resistance and pitting resistance compared to known stainless steels such as Type 316, Gall-Tough ®, or Nitronic 60 ®.

SUMMARY OF THE INVENTION

In accordance with this invention, a duplex (ferritic-austenitic) stainless steel alloy is provided that has improved galling resistance compared to Type 316 stainless steel in combination with mechanical properties and corrosion resistance properties that are at least as good as Type 316. The duplex alloy according to the present invention consists essentially of, in weight percent, about:

| | Broad | Intermediate | Preferred |
|---|---|---|---|
| C | 0.1 Max. | 0.05 Max. | 0.025 Max. |
| Mn | 0–6 | 1–4 | 1–3 |
| Si | 2.5–6 | 3–6 | 4–5 |
| Cr | 16–24 | 17–22 | 18–21 |
| Ni | 2–12 | 6–10 | 7–9 |
| Mo | 4 Max. | 0.5–3 | 1.0–2 |
| N | 0.07–0.30 | 0.10–0.25 | 0.15–0.20 |

and the balance of the alloy is essentially iron except for minor amounts of additional elements which do not detract from the desired properties and the usual impurities found in commercial grades of such steels which may vary in amount from a few hundredths of a percent up to larger amounts that do not objectionably detract from the desired combination of properties provided by the alloy. For example, the balance can include up to about 0.03%, preferably no more than about 0.015% sulfur, and up to about 0.06%, preferably no more than about 0.02% phosphorus; up to about 0.5%, preferably no more than about 0.2%, of each of the elements tungsten, vanadium, and columbium.

The foregoing tabulation is provided as a convenient summary and is not intended thereby to restrict the lower and upper values of the ranges of the individual elements of the alloy of this invention for use solely in combination with each other or to restrict the broad, intermediate or preferred ranges of the elements for use solely in combination with each other. Thus, one or more of the broad, intermediate and preferred ranges can be used with one or more of the other ranges for the remaining elements. In addition, a broad, intermediate or preferred minimum or maximum for an element can be used with the maximum or minimum for that element from one of the remaining ranges. Throughout this application, unless otherwise indicated, all compositions in percent will be in percent by weight.

In the alloy according to the present invention, the elements are balanced to provide an improved combination of galling resistance and corrosion resistance in a duplex microstructure consisting essentially of austenite and ferrite. In this regard, the relative proportions of austenite and ferrite, the austenite stability factor (ASF), and the Ni/Si ratio are controlled to provide superior galling resistance. More specifically, the ferrite-forming elements and the austenite-forming elements are balanced so that, in the annealed condition, the v/o ferrite in the microstructure is at least about 15 v/o, but not more than about 50 v/o. The ASF of the alloy, defined by Floreen and Mayne in the *Handbook of Stainless Steels, p.* 4–29, (Peckner & Bernstein ed. 1977) as the relationship % Ni+0.68(% Cr)+0.55(% Mn)+0.45(% Si)+27(% C+% N)+% Mo+0.2(% Co), is at least about 27.5. Furthermore, the Ni/Si ratio of the alloy is not greater than about 2.5. Additionally, the combined weight percentage of chromium plus molybdenum is controlled to provide the desired corrosion resistance.

In accordance with another aspect of the present invention, there is provided an article made from this alloy which has been annealed in the temperature range of approximately 1850–2150 F. (1010–1177 C.).

DETAILED DESCRIPTION OF THE INVENTION

In the alloy according to the present invention, silicon is important because it contributes to the good galling resistance of this alloy. Good galling resistance is defined as a threshold galling stress (TGS) of about 4 to 12 ksi (27.6 to 82.7 MPa). Silicon also benefits the stability of the surface oxide layer and acts as a deoxidizing agent during refining of the alloy. Therefore, at least about 2.5% and better yet at least about 3% silicon is present in this alloy. High levels of silicon promote formation of an excessive amount of ferrite, which at levels greater than about 50 v/o can adversely affect galling resistance. Silicon also promotes the formation of sigma phase, an undesirable brittle phase, and reduces nitrogen solubility in this alloy. Silicon is, therefore, limited to not more than about 6%. It is preferred that the alloy contain about 4–5% silicon.

Nitrogen is a strong austenite former, up to 30 times as effective as nickel for austenite formation, and nitrogen stabilizes austenite against transformation to martensite. Nitrogen also benefits the pitting resistance and the galling resistance of this alloy. Therefore, at least about 0.07%, better yet at least about 0.10% or about 0.125% nitrogen is present in this alloy. Nitrogen can be present up to its limit of solubility in this alloy, which may be up to about 0.30%, but for ease of manufacture, the alloy preferably contains not more than about 0.25% nitrogen. For best results this alloy contains about 0.15–0.20% nitrogen.

Carbon, like nitrogen, is a strong austenite former and stabilizes austenite against transformation to martensite. Carbon also contributes to the tensile strength and yield strength of this alloy and does not degrade galling resistance. Therefore, up to about 0.1% carbon can be present in this alloy. Too much carbon results in sensitization of the alloy which adversely affects the alloy's resistance to intergranular corrosion. Further, excessive carbon adversely affects the general corrosion resistance and weldability of this alloy. For these reasons it is preferred that not more than about 0.05% carbon, and for best results not more than about 0.025% carbon is present in this alloy.

Manganese can be present in this alloy and preferably at least about 1% manganese is present in this alloy because is contributes to the formation of austenite in the alloy and stabilizes the austenite against transformation to martensite. Manganese also increases nitrogen solubility. High levels of manganese promote the formation of sigma phase which is undesirable. For this reason, manganese is restricted to not more than about 6.0%, better yet to not more than about 4.0%, and for best results to not more than about 3% in this alloy.

Chromium and molybdenum contribute to the good corrosion resistance of this alloy. In particular, molybdenum benefits the pitting resistance of this alloy. Chromium and molybdenum increase nitrogen solubility and also stabilize the austenite against transformation to martensite. For these reasons at least about 16%, better yet at least about 17%, chromium and preferably at least about 0.5%, better yet at least about 1.0%, molybdenum are present in this alloy. When less than about 0.5% molybdenum is present, the combined weight percentage of chromium plus molybdenum should be at least about 20% to provide the good corrosion resistance that is characteristic of this alloy. Chromium and molybdenum are strong ferrite formers and in excessive amounts promote the formation of sigma phase which is undesirable. Accordingly, chromium is restricted to not more than about 24%, better yet to not more than about 22%, and molybdenum is restricted to not more than about 4%, better yet to not more than about 3%. For best results, about 18–21% chromium and about 1.0–2% molybdenum are present in this alloy.

Nickel contributes to the formation of austenite and stabilizes it against transformation to martensite. Nickel also benefits the general corrosion resistance of the alloy of this invention, particularly in acids such as hydrochloric acid or sulfuric acid. Nickel also contributes to the ductility of this alloy. Therefore at least about 2.0%, better yet at least about 6% nickel is present in this alloy. Too much nickel adversely affects the galling resistance of this alloy and reduces nitrogen solubility in the alloy. For these reasons, not more than about 12%, better yet not more than about 10% nickel is present in this alloy. For best results about 7–9% nickel is present in the alloy.

The balance of the alloy is essentially iron except for the usual impurities found in commercial grades of alloys intended for similar service or use. The levels of such elements are controlled so as not to adversely affect the desired properties. For example, up to about 0.025% aluminum, up to about 0.010% calcium or magnesium, and up to about 0.02% misch metal and up to about 0.2% titanium may be retained from deoxidizing additions.

Optional elements that contribute to desirable properties can be present in amounts that do not detract from the desired combination of properties. In this regard, a small but effective amount of boron, about 0.001–0.005%, preferably about 0.001–0.003% can be present in this alloy for its beneficial effect on hot workability. When desired, up to about 3.0% copper can be present in this alloy because it benefits the general corrosion resistance of the alloy, particularly corrosion resistance in acid environments and because it promotes and stabilizes austenite. However, it is preferred that not more than about 0.75% copper be present. When desired, up to about 5.0% cobalt can also be present in addition to or in partial substitution for nickel because of its beneficial effect on galling resistance and corrosion resistance. However, cobalt is preferably restricted to a residual amount, e.g., less than about 0.75%. If desired, 0.1% to 0.3% each of sulfur or selenium can be present in this alloy to provide better machinability.

Within the weight percent limits for the various elements, the elements, C, Mn, Si, Ni, Cr, Mo, and N are balanced to control the relative proportions of ferrite and austenite in this alloy. In this regard, it is preferred that in the annealed condition the alloy contain at least about 15 v/o ferrite in order to obtain the benefit to corrosion resistance provided by the ferrite forming elements chromium and molybdenum. It is also preferred that the alloy contain not more than about 50 v/o ferrite because too much ferrite adversely affects the galling resistance of the alloy. Stated conversely, the alloy according to this invention contains about 50–85 v/o austenite.

In the stainless steel according to the present invention, it is also important to control the stability of the austenite and the nickel to silicon ratio to obtain the good galling resistance that is characteristic of this alloy. Accordingly, within their respective weight percent limits, the elements are balanced in accordance with the following relationship:

$$ASF = \%\ Ni + 0.68(\%\ Cr) + 0.55(\%Mn) + 0.45(\%\ Si) + 27(\%\ C + \%\ N) + \%\ Mo + 0.2(\%\ Co)$$

such that ASF is at least about 27.5. Also, nickel and silicon are balanced such that the Ni/Si ratio is not greater than about 2.5.

It is to be understood that in controlling the relative proportions of ferrite and austenite, the austenite stability, and the Ni/Si ratio, a small deviation from the specified range of any of those parameters can be counterbalanced by an adjustment of one or both of the other factors. Accordingly, the alloy of the present invention is not restricted to the preferred numerical ranges recited for each of those factors. For example, a composition having slightly more than 50% ferrite still provides the desired combination of galling resistance and corrosion resistance when it is balanced to maximize the ASF or to minimize the nickel to silicon ratio.

No special techniques are required in melting, casting, or working the alloy of the present invention. Arc melting with argon-oxygen decarburization is preferred, but other practices can be used. The initial ingot can be cast as an electrode and remelted to enhance homogeneity. This alloy can also be made by powder metallurgy techniques if desired.

The alloy can be hot worked from a furnace temperature of about 2100–2400 F. (1149–1316 C.), preferably from about 2250–2400 F. (1232–1316 C.), and for best results from about 2300 F. (1260 C.), with reheating as necessary. Annealing can be carried out at about 1850–2150 F. (1010–1177 C.). To provide the combination of good galling and corrosion resistance, an article made from this alloy is annealed preferably at about 1950–2050 F. (1066–1121 C.), and for best results at about 1950 F. (1066 C.), depending on the composition of the alloy, for a time depending upon the dimensions of the article. The article is then quenched from the annealing temperature, preferably in water.

The alloy of the present invention can be formed into a variety of shapes for a wide variety of uses and it lends itself to the formation of billets, bars, rod, wire, strip, plate or sheet using conventional practices. The preferred practice is to hot work the ingot to billet form with a rotary forge followed by hot rolling the billet to bar, wire, or strip.

EXAMPLES

Set forth in Table I are the weight percent compositions of Examples 1–13 of the alloy according to this invention and comparative Heats A–I. Examples 1–8 and 13 and comparative Heats A–C, G and H were induction melted under argon and cast as 2¾ in (7 cm) sq ingots. The ingots were forged from 2200 F. (1204 C.) to 1⅛ in (2.9 cm) sq bars. A portion of each forged bar was turned to one inch round bar. Examples 9–12 of this invention and comparative Heats D–F, and I were prepared in a manner similar to Examples 1–8 and 13 and Heats A–C, G and H with the exception that the ingots were forged from 2300 F. (1260 C.).

The composition of Heat G is representative of the alloy sold under the trademark Gall-Tough®. The composition of Heat H is representative of the alloy sold under the trademark Nitronic 60®. The composition of Heat I is representative of Type 316 stainless steel.

TABLE I

| Ex./ Ht. No. | C | Mn | Si | Cr | Ni | Mo | Cu | N | Fe |
|---|---|---|---|---|---|---|---|---|---|
| 1 | .028 | 1.97 | 3.92 | 19.92 | 8.00 | <.01 | .20 | .11 | Bal. |
| 2 | .024 | 1.98 | 3.95 | 20.97 | 8.08 | .99 | .20 | .17 | Bal. |
| 3 | .026 | 1.97 | 4.02 | 18.04 | 7.91 | 2.02 | .20 | .11 | Bal. |
| 4 | .022 | 1.99 | 3.93 | 19.40 | 7.91 | 2.03 | .20 | .11 | Bal. |
| 5 | .026 | 1.98 | 4.96 | 17.91 | 9.03 | 2.02 | .20 | .11 | Bal. |
| 6 | .027 | 1.98 | 3.99 | 19.93 | 7.93 | 2.02 | .20 | .16 | Bal. |
| 7 | .026 | 1.95 | 3.96 | 20.15 | 9.01 | 2.02 | .21 | .16 | Bal. |
| 8 | .021 | 2.04 | 3.98 | 20.86 | 7.96 | 1.94 | .20 | .15 | Bal. |
| 9 | .018 | 2.01 | 3.97 | 18.01 | 7.88 | 2.07 | .22 | .11 | Bal. |
| 10 | .021 | 2.00 | 3.90 | 18.02 | 8.92 | 2.07 | .22 | .11 | Bal. |
| 11 | .027 | 3.93 | 3.90 | 18.19 | 8.14 | 2.01 | .21 | .13 | Bal. |
| 12 | .013 | 5.77 | 4.04 | 17.98 | 8.16 | 2.01 | .20 | .13 | Bal. |
| 13 | .100 | 5.48 | 2.58 | 20.21 | 2.58 | <.01 | — | .21 | Bal. |
| A | .022 | 1.97 | 2.99 | 19.46 | 7.97 | 2.00 | .20 | .11 | Bal. |
| B | .024 | 1.98 | 3.03 | 18.14 | 6.95 | 2.00 | .20 | .11 | Bal. |
| C | .022 | 1.99 | 3.90 | 20.85 | 7.80 | 2.05 | .22 | .10 | Bal. |
| D | .018 | 2.00 | 4.02 | 17.95 | 6.85 | 2.05 | .22 | .10 | Bal. |
| E | .024 | 1.98 | 3.93 | 18.03 | 6.60 | 2.00 | .20 | .10 | Bal. |
| F | .026 | 1.99 | 3.97 | 17.82 | 6.46 | <.01 | .22 | .10 | Bal. |
| G | .103 | 5.55 | 3.40 | 16.21 | 5.04 | .26 | .27 | .11 | Bal. |
| H | .076 | 8.36 | 4.20 | 16.22 | 8.44 | .22 | .28 | .14 | Bal. |
| I | .059 | 1.67 | .56 | 18.68 | 12.29 | 2.33 | .29 | .046 | Bal. |

To determine the v/o austenite in the microstructure, two longitudinal metallographic specimens were cut from the one inch round bar of each heat. The specimens were annealed at 1950 F. (1066 C.) for one hour and water quenched. A test sample was then cut from each specimen, ground, degreased, cleaned, dried, and weighed. Metallographic examination was performed by image analysis to determine the v/o austenite.

To determine the galling resistance of the various heats in Table I, specimens of Examples 1–13 and comparative Heats A–F were prepared and tested as follows. The forged bar of each composition was turned to one inch round. Galling test buttons and blocks were machined from the round bars. The test buttons and blocks of Examples 1–8 and Heats A–C were annealed at 1950 F. (066 C.) for one hour and quenched in water. The test buttons and blocks of Examples 9–12 and Heats D–F were annealed at 1950 F. (1066 C.) for 0.75 hours and water quenched, and the test buttons and blocks of Example 13 were annealed at 2050 F. (1121

C.) for one hour and water quenched. To determine the galling resistance of each heat, parallel, flat, test surfaces, 0.875in (2.2 cm) wide, were machine ground on opposite sides of each block. One of the test surfaces of each block was ground to have a roughness of 15–40 (Ra) micro-inches, (Ra being the roughness parameter).

Each button was machined to form two tiers with parallel flats forming the opposite end surfaces of the button. One tier, forming the test surface of each button, had a reduced diameter of about 0.5 in (1.3 cm) ±0.002 in (±0.0051 cm) and a machine ground surface with a roughness of 15–40 (Ra) microinches (0.38–1.02 micrometers). A flat was milled on a side of each button for turning the button with a wrench and a centering hole provided in the end of each button opposite its machine-ground test surface. The test surfaces of each button and block pair were deburred, then their roughness was measured using a profilometer and recorded.

The buttons and blocks were cleaned to remove machining oils and metal particles and then the threshold galling stress, TGS, for each example was determined in a Tinius-Olsen Tensile machine as follows. A block made from one of the example compositions was fixed in a jig below the mandrel of the tensile testing machine. A button of the same composition was then placed on the block with its test surface against the test surface of the block. The mandrel was then lowered so that the tip of the mandrel was tightly secured in the centering hole of the button. A compressive load was applied to the button/block combination, resulting in a predetermined compressive stress therein. The button was then rotated smoothly with a wrench as follows: counterclockwise 360°, clockwise 360°, and then counterclockwise 360°. The compressive load was then removed, and the test surfaces visually examined for galling. If no galling was observed a new button of the same composition was tested at a higher compressive stress level. Threshold galling stress values were determined to within ±1 ksi (6.98 MPa). Duplicate samples were tested to confirm the threshold galling stress values for the specimens except for about six tests where available materials did not permit. The highest stress in ksi at which galling did not occur is defined herein as the TGS.

Set forth in Table II are the v/o austenite (% Aust.), the threshold galling stress (TGS), in ksi, the ratio of Ni to Si (Ni/Si Ratio), and the austenite stability factor (A.S.F.) for Examples 1–13 and Heats A–F in Table I.

TABLE II

| Ex./Ht. No. | v/o Aust. | TGS ksi (MPa) | Ni/Si Ratio | A.S.F.[1] |
|---|---|---|---|---|
| 1 | 63 | 8 (55.2) | 2.04 | 28.12 |
| 2 | 64 | 7 (48.3) | 2.05 | 31.43 |
| 3 | 62 | 7 (48.3) | 1.97 | 28.78 |
| 4 | 53 | 5 (34.5) | 2.01 | 29.56 |
| 5 | 49 | 12 (82.8) | 1.82 | 30.22 |
| 6 | 58 | 6 (41.4) | 1.99 | 31.44 |
| 7 | 68 | 5 (34.5) | 2.28 | 32.61 |
| 8 | 46 | 6 (41.4) | 2.00 | 31.61 |
| 9 | 65 | 5 (34.5) | 1.98 | 28.54 |
| 10 | 74 | 5,7 (34.5,48.3) | 2.29 | 29.64 |
| 11 | 74 | 4 (27.6) | 2.09 | 30.67 |
| 12 | 70 | 5 (34.5) | 2.02 | 31.25 |
| 13 | 69 | 5 (34.5) | 1.00 | 28.32 |
| A | 73 | 1 (6.9) | 2.67 | 28.39 |
| B | 69 | <2 (<13.8) | 2.29 | 27.35 |
| C | 38 | 2 (13.8) | 2.00 | 30.14 |
| D | 53 | <1,4 (<6.9,13.8) | 1.70 | 27.20 |
| E | 47 | <1,<1 (<6.9,<6.9) | 1.68 | 27.06 |
| F | 65 | <1,<1 (<6.9,<6.9) | 1.62 | 24.85 |

[1]% Ni + .68% Cr + .55% Mn + .45% Si + 27(% C + % N) + % Mo + .2% Co

A comparison of Examples 3 and 4, and Heat C shows the direct influence of v/o austenite (v/o ferrite) on galling resistance. Examples 3 and 4, and Heat C have similar compositions except for the % chromium, Example 3 having 18.04% Cr, Example 4 having 19.40% Cr, and Heat C having 20.85% Cr. Examples 3 and 4 with more than 50% austenite each have significantly higher TGS values than Heat C which has less than 50% austenite.

The data in Table II also demonstrates that within the weight percent ranges of the present alloy, to attain the superior galling resistance characteristic of the present invention, it is necessary to control austenite stability. A comparison of Example 1 and Heat F demonstrates the beneficial effect of austenite stability on galling resistance. Example I and Heat F have the same % Si and % austenite, but have significantly different threshold galling stress levels, 8 ksi (55.2 MPa) vs. 1 ksi (6.9 MPa), respectively. Example 1 has a significantly higher austenite stability factor, 28.12, than Heat F, 24.85, because of its Cr and Ni contents.

The data in Table II further demonstrates that within the elemental ranges stated herein, to attain the superior galling resistance characteristics in the present invention, it is necessary to control the Ni/Si ratio. For example, while Heat A has an austenite stability factor greater than 27.5 and 73 v/o austenite, its TGS is only 1 ksi due in part to a Ni/Si ratio of 2.67. By comparison Example 13, has very low silicon, 2.58%, a very similar austenite stability factor, 28.32, and a 69% austenitic microstructure. Example 13, however, had a TGS of 5 ksi (34.5 MPa) due to its low Ni/Si ratio of 1.00.

Examples 5 and 8 illustrate that a small deviation from the specified range of any one of the aforementioned parameters for providing good galling resistance can be counterbalanced by an adjustment of one or both of the other factors. Examples 5 and 8 have 49% and 46% austenite, respectively, amounts that are slightly less than 50% austenite, the specified minimum volumetric percentage. Yet Examples 5 and 8 exhibit good galling resistance because Example 5 has very high silicon and a correspondingly low Ni/Si ratio and Example 8 has a very high A.S.F.

To demonstrate the pitting resistance of the alloy according to the present invention strip specimens were prepared and tested as follows. A portion of the 1⅛ in (2.9 cm) sq bar of Heats 9–11 and Heats F–I was shaped to approximately lin sq, hot rolled to approximately 0.250in (0.64 cm) thick strip from 2300 F. (1260 C.). The strip was then annealed at 2050 F. (1121 C.) for 0.75 hours, water quenched, cold rolled to approximately 0.130 in (0.33 cm) thick, and annealed at 1950 F. (1066 C.) for 5 minutes and air cooled. Specimens were then cut and machined from the cold-rolled annealed strip.

The strip specimens were then tested for general pitting resistance in 6% $FeCl_3$ at room temperature for 72 hours in accordance with ASTM G-48.

The corrosion rates are shown in Table III.

TABLE III

| Ex./Ht. No. | Chemical Analysis C | Mn | Si | Cr | Ni | Mo | Cu | N | Fe | Pitting Resistance (mg/cm²) |
|---|---|---|---|---|---|---|---|---|---|---|
| 9 | .018 | 2.01 | 3.97 | 18.01 | 7.88 | 2.07 | .22 | .11 | Bal. | <0.1,<0.1 |
| 10 | .021 | 2.00 | 3.90 | 18.02 | 8.92 | 2.07 | .22 | .11 | Bal. | <0.1,<0.1 |
| 11 | .027 | 3.93 | 3.90 | 18.19 | 8.14 | 2.01 | .21 | .13 | Bal. | <0.1,<0.1 |
| F | .026 | 1.99 | 3.97 | 17.82 | 6.46 | <0.01 | .22 | .10 | Bal. | 10.0,7.0 |
| G | .103 | 5.55 | 3.40 | 16.21 | 5.04 | .26 | .27 | .11 | Bal. | 17.5,16.6 |
| H | .076 | 8.36 | 4.20 | 16.22 | 8.44 | .22 | .28 | .14 | Bal. | 17.0,17.2 |
| I | .059 | 1.67 | .56 | 18.68 | 12.29 | 2.33 | .29 | .046 | Bal. | 4.0,3.3 |

The data in Table III demonstrates that Examples 9–11 have superior pitting resistance compared to Type 316 (Heat I), Gall-Tough® (Heat G) and Nitronic 60® (Heat H), each of which was heavily attacked.

The terms and expressions which have been employed are used as terms of description and not of limitation, and there is not intention in the use of such terms and expressions of excluding any equivalents of the features shown and described or portions thereof, but it is recognized that various modifications are possible within the scope of the invention claimed.

What is claimed is:

1. A duplex, stainless steel alloy having a good combination of galling resistance and corrosion resistance, said alloy consisting essentially of, in weight percent, about

| | % |
|---|---|
| Carbon | 0.1 max. |
| Manganese | 6 max. |
| Silicon | 2.5–6 |
| Chromium | 16–24 |
| Nickel | 2–12 |
| Molybdenum | 4 max. |
| Nitrogen | 0.07–0.30 |
| Copper | 3.0 max. |
| Cobalt | 5 max. |
| Sulfur | 0.3 max. |
| Boron | 0.005 max. |

and the balance is essentially iron, wherein the ratio Ni/Si is not more than about 2.5; $Ni+0.68(\%\ Cr)+0.55(\%\ Mn)+0.45(\%\ Si)+27(\%\ C+\%\ N)+Mo+0.2(\%\ Co)\geqq 27.5$; and said elements are balanced such that in the annealed condition, said alloy contains about 15–50 v/o ferrite.

2. The alloy as set forth in claim 1 in which Mo+% Cr is at least about 20% when the % Mo is less than about 0.5%.

3. The alloy as set forth in claim 1 having not more than about 0.75% cobalt.

4. The alloy as set forth in claim 1 containing at least about 0.5% molybdenum.

5. The alloy as set forth in claim 1 having at least about 0.10% nitrogen.

6. The alloy as set forth in claim 1 having at least about 1.0% manganese.

7. The alloy as set forth in claim 1 having not more than about 0.75% copper.

8. The alloy as set forth in claim 1 having not more than 0.03% sulfur.

9. A duplex, stainless steel alloy having a good combination of galling resistance and corrosion resistance, said alloy consisting essentially, in weight percent, of about

| | % |
|---|---|
| Carbon | 0.05 max. |
| Manganese | 1–4 |
| Silicon | 3–6 |
| Chromium | 17–22 |
| Nickel | 6–10 |
| Molybdenum | 0.5–3 |
| Nitrogen | 0.10–0.25 |
| Copper | 3.0 max. |
| Cobalt | 5 max. |

and the balance is essentially iron, wherein the ratio Ni/Si is not more than about 2.5; $Ni+0.68(\%\ Cr)+0.55(\%\ Mn)+0.45(\%\ Si)+27(\%\ C+\%\ N)+Mo\ \%+0.2(\%\ Co)\geqq 27.5$; and said elements are balanced such that in the annealed condition, said alloy contains about 15–50 v/o ferrite.

10. The alloy as set forth in claim 9 having not more than about 0.75% cobalt.

11. The alloy as set forth in claim 9 having at least about 0.15% nitrogen.

12. The alloy as set forth in claim 9 having not more than about 0.75% copper.

13. The duplex, stainless steel alloy as set forth in claim 9 consisting essentially, in weight percent, of about

| | % |
|---|---|
| Carbon | 0.025 max. |
| Manganese | 1–3 max. |
| Silicon | 4–5 |
| Chromium | 18–21 |
| Nickel | 7–9 |
| Molybdenum | 1.0–2 |
| Nitrogen | 0.15–0.20 |

14. The alloy as set forth in claim 13 having not more than about 0.75% cobalt and not more than about 0.75% copper.

15. An article formed of a duplex, stainless steel alloy consisting essentially, in weight percent, of about

| | % |
|---|---|
| Carbon | 0.1 max. |
| Manganese | 6 max. |
| Silicon | 2.5–6 |
| Chromium | 16–24 |
| Nickel | 2–12 |
| Molybdenum | 4 max. |
| Nitrogen | 0.07–0.30 |

and the balance is essentially iron, wherein the ratio Ni/Si is not more than about 2.5; % Ni+0.68(% Cr)+0.55(% Mn)+0.45(% Si)+27(% C+% N)+% Mo+0.2(% Co)≧27.5;

and, said elements having been balanced and said article having been annealed at a temperature and for a time sufficient to provide about 15-50 v/o ferrite in said alloy.

16. An article as set forth in claim 15 which has been annealed at a temperature of about 1850 F. (1010 C.) to 2150 F. (1177 C.).

17. An article as set forth in claim 15 which has been annealed at a temperature of about 1950 F. (1066 C.) to 2050 F. (1121 C.).

18. An article as set forth in claim 15 which has been annealed at about 1950 F. (1066 C.).

19. An article as set forth in claim 15 having a threshold galling stress of at least about 4 ksi (27.6 MPa).

20. An article as set forth in claim 15 wherein the alloy contains

| | % |
|---|---|
| Carbon | 0.05 max. |
| Manganese | 1-4 max. |
| Silicon | 3-6 |
| Chromium | 17-22 |
| Nickel | 6-10 |
| Molybdenum | 0.5-3 |
| Nitrogen | 0.10-0.25 |

21. An article as set forth in claim 15, wherein the alloy contains

| | % |
|---|---|
| Carbon | 0.025 max. |
| Manganese | 1-3 max. |
| Silicon | 4-5 |
| Chromium | 18-21 |
| Nickel | 7-9 |
| Molybdenum | 1.0-2 |
| Nitrogen | 0.15-0.20 |

* * * * *

UNITED STATES PATENT AND TRADEMARK OFFICE

CERTIFICATE OF CORRECTION

PATENT NO. : 5,254,184

DATED : October 19, 1993

INVENTOR(S) : MAGEE, Jr., KOSA and SCHLOSSER

It is certified that error appears in the above-indentified patent and that said Letters Patent is hereby corrected as shown below:

Abstract:
Line 16, insert --27-- before "(%C + %N).

Column 6:
Line 64, "(066C.) should be --(1066C.)--.

Column 8:
Line 59, "0.250in" should be -- 0.250 in--.

Column 9, Claim 1, line 19, "Ni" should be --%Ni--;
line 20, "Mo" should be --%Mo--.

Claim 2, line 1, "Mo" should be --%Mo--.

Column 10, Claim 9, line 18, "Mo%" should be --%Mo--.

Signed and Sealed this

Fifth Day of March, 1996

Bruce Lehman

*Attest:*

BRUCE LEHMAN

*Attesting Officer*

*Commissioner of Patents and Trademarks*